US005829524A

United States Patent [19]

Flanders et al.

[11] Patent Number: 5,829,524

[45] Date of Patent: Nov. 3, 1998

[54] HIGH PRESSURE CASING PATCH

[75] Inventors: Bruce A. Flanders; Gerald D. Lynde; John Macrae, all of Houston, Tex.

[73] Assignee: Baker Hughes Incorporated, Houston, Tex.

[21] Appl. No.: 624,921

[22] Filed: May 7, 1996

[51] Int. Cl.[6] ..... F21B 17/02

[52] U.S. Cl. ..... 166/277; 166/242.7; 285/351; 285/917

[58] Field of Search ..... 166/277, 242.6, 166/242.7; 294/86.34, 86.26; 285/302, 351, 917, 382

[56] References Cited

U.S. PATENT DOCUMENTS

| | | | |
|---|---|---|---|
| 1,634,891 | 7/1927 | Trout | 285/351 X |
| 2,017,451 | 10/1935 | Wickersham | 166/277 X |
| 2,593,725 | 4/1952 | Brown | 166/277 |
| 3,163,217 | 12/1964 | Haeber | 166/277 |
| 3,710,864 | 1/1973 | Mitchell | 166/242.6 |
| 3,865,408 | 2/1975 | Young . | |
| 4,660,863 | 4/1987 | Bailey, et al. . | |
| 4,796,709 | 1/1989 | Lynde et al. | 166/55.6 |
| 4,830,109 | 5/1989 | Wedel | 166/277 |
| 4,907,651 | 3/1990 | Bou-Mikael | 166/242.6 |
| 5,333,692 | 8/1994 | Baugh et al. | 166/387 |
| 5,456,312 | 10/1995 | Lynde et al. | 166/55.6 |

FOREIGN PATENT DOCUMENTS 418056 3/1991 United Kingdom .

OTHER PUBLICATIONS

Baker Oil Tools, Catalog, Fishing Services, pp. 13–16, 54, date unknown.

Composite Catalog, Bowen Packer Type Tubing and Casing Patches,Bowen Lwad Seal Tubing and Casing Patches, date unknown.

Gotco International, Inc., Casing Patch, p. 12, date unknown.

*Primary Examiner*—Hoang C. Dang
*Attorney, Agent, or Firm*—Rosenblatt & Redano, P.C.

[57] ABSTRACT

A casing patch is disclosed which uses one or more fins which elastically flex to accept a casing stub. The casing stub is prepared with a dressing tool containing a special mill to obtain the requisite finish on its outer surface prior to insertion of the casing patch. The flexible fin or fins provide a metal-to-metal seal to the outer surface of the casing patch and a grip assembly holds the joint together. In certain applications, the fins can be combined with a resilient seal where the fins preferably provide a complete extrusion barrier to the resilient seals. Using the fins which preferably are integral to the body, alone or in combination with a resilient seal or seals, the wall thickness of the joint can be maintained at thicker values for a given size as compared to prior designs, thus, ensuring a sufficient pressure rating for the joint which is at least equal to the rating of the casing stub.

33 Claims, 3 Drawing Sheets

HIGH PRESSURE CASING PATCH

FIELD OF THE INVENTION

The field of this invention relates to casing patches for use in repair of broken or damaged casing downhole.

BACKGROUND OF THE INVENTION

During service or as a result of well operations, casing failures have occurred. One repair technique for such failures has been to remove that portion of the casing above the break and insert new casing with what has been referred to as a casing patch at the lower end. The casing patch goes over the top end of the remaining casing in the well. "Casing" as used herein includes any tubular used downhole. In general, prior casing patches have offered a seal of one type or another in conjunction with a gripping member to hold the casing patch together. In some designs the sealing material has been lead. Such products have been offered by Baker Oil Tools under Product Nos. 160-21, 162-20, and 163-20. Other designs have used opposed chevron seals in what is known as a high pressure pack-off assembly such as that sold by Baker Oil Tools under Product No. 110-59. This accessory allows latching onto a fish and thereafter applying pressure. Blades are provided at the lower end to facilitate acquisition of the fish by milling the jagged top of the fish free of surface irregularities.

The designs involving the use of lead have created excessive radial forces on the casing patch body or the casing itself against which the seal is desired. In some cases the body has ballooned outward due to the inner pressure or in others the casing itself has collapsed. Some of these designs are not releasable.

Releasable casing patches have previously been offered by Bowen Tools in its packer-type tubing and casing patches. This design has featured a spiral wound grapple design which allows disengagement from the fish if a seal is not created for any reason. The Bowen design has used a large rubber ring as the sealing element. In view of the environment in which these casing patches must be inserted, a limited space is available which has resulted in thinning the wall in the Bowen design to accommodate the presence of the rubber seal ring. The thinning of the wall in an effort to control the outside diameter of the casing patch in turn has resulted in a low burst pressure rating for this particular design. Other designs, such as the Baker Oil Tools' High Pressure Pack-Off, require the use of fairly thick packing which in turn reduces the available wall thickness around the packing and reduces the pressure limits of the joint. Other designs of casing patches, such as those made by Gotco International, Inc. use individual elastomer rings inserted into the patch body in separate grooves. This design allows for extrusion gaps due to irregularities in the casing dimensions, thereby limiting its ability to retain pressure once the joint is assembled.

Typically, casing, once exposed in the wellbore, can have pitting corrosion or general deterioration of its outer surface. The prior designs of patches were required to seal this uneven surface. In prior applications, a service company would run a dressing tool that simply created a top bevel on the casing to facilitate insertion of the patch over the top of the casing and to reduce the potential for damage to the seal on the casing patch during insertion. While such tools produced the desired top bevel, below that the lower portion of the mill would gouge and severely scratch the casing outside surface. This in turn reduced the surface quality for the seal which caused leaks of the patch under pressure. The tolerance of casing outside diameter is governed by the American Petroleum Institute which states that casing outside diameter can vary +1% to −0.5%. Therefore, for a 9⅝" nominal outside diameter casing, the diameter can be as much as 0.096 inch oversize to as little as 0.048 inch undersize. Prior casing patches that use chevron or V-type packing have been less than effective due to the large variances in dimensions.

Accordingly, the present apparatus and method have as their objective to properly prepare the outer surface of the casing stub in the wellbore prior to insertion of the casing patch. With the outer surface of the stub prepared, another objective is to provide a casing patch using one or more fins which can flex as the joint is put together to provide an adequate seal for the casing. Another objective is to improve the seal obtained in the casing patch by combining the use of one or more fins for extrusion barriers in combination with any elastomeric or rubber sealing component which can be significantly thinner than prior designs that lacked extrusion barriers to allow for less reduction in wall for accommodation of the seal. It is a further objective to accommodate the irregularities of the casing by using a series of fins at different diameters to compensate for such dimensional variations. Another objective is to provide a dressing tool for the stub portion of the casing in the wellbore which can adequately prepare the outer surface of the stub, in place, to facilitate the reliability of the casing patch, whether using one or more fins or in conjunction with one or more resilient seals.

SUMMARY OF THE INVENTION

A casing patch is disclosed which uses one or more fins which elastically flex to accept a casing stub. The casing stub is prepared with a dressing tool containing a special mill to obtain the requisite finish on its outer surface prior to insertion of the casing patch. The flexible fin or fins provide a metal-to-metal seal to the outer surface of the casing patch and a grip assembly holds the joint together. In certain applications, the fins can be combined with a resilient seal where the fins preferably provide a complete extrusion barrier to the resilient seals. Using the fins, which preferably are integral to the body, alone or in combination with a resilient seal or seals, the wall thickness of the joint can be maintained at thicker values for a given size as compared to prior designs, thus, ensuring a sufficient pressure rating for the joint which is at least equal to the rating of the casing stub.

DETAILED DESCRIPTION OF THE PREFERRED EMBODIMENT

Figure 1:
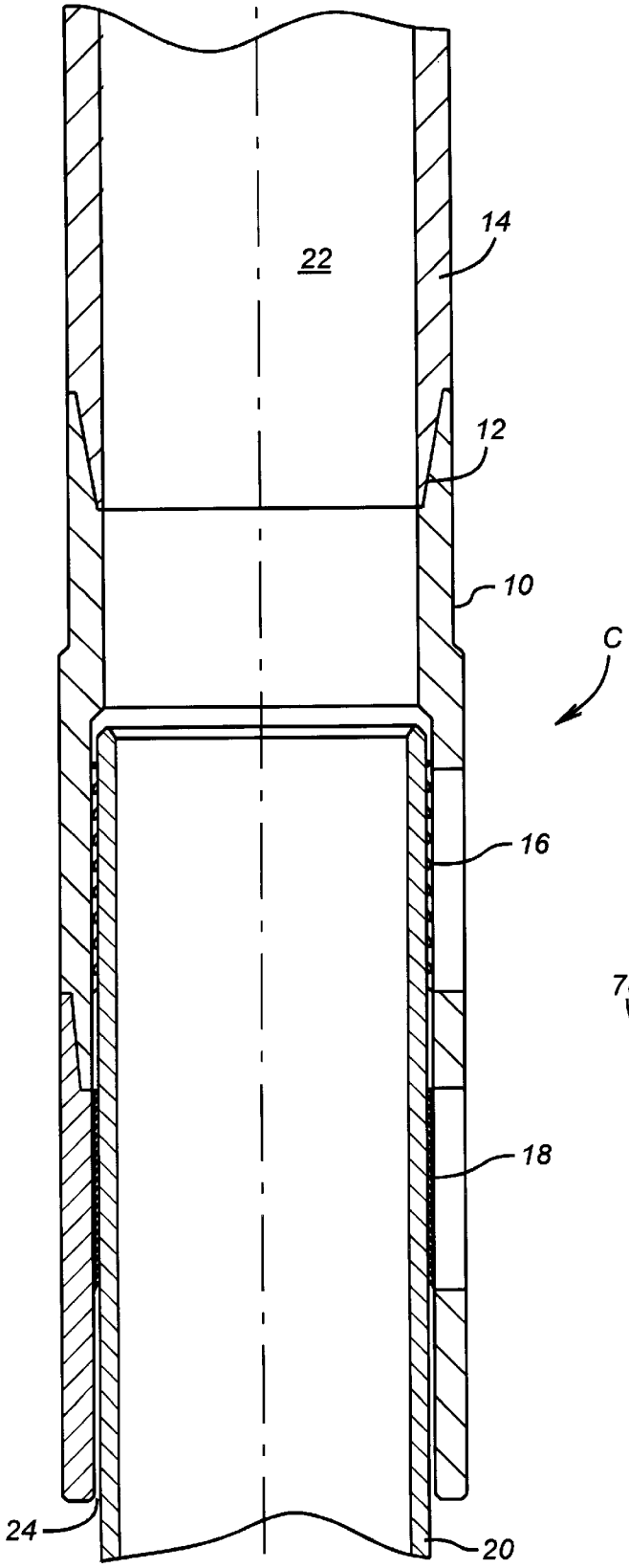
FIG. 1 is a schematic sectional elevational view of the casing patch fully assembled.

The casing patch C is illustrated schematically in FIG. 1. It has a body 10 with a thread 12 to allow engagement to the newly run casing 14. Body 10 has a seal area 16 and a slip or gripping area 18. The body 10 goes over the old casing stub 20 which is shown in cross-hatch in FIG. 1. The slip area 18 encompasses any one of several known gripping techniques which are activated by a longitudinal force applied to the new casing 14 from the surface. The seal area 16 seals the joint so that pressures internal to the joint in flow path 22 do not escape out through the annular space 24 formed between the old casing 20 and the body 10.

Figure 4:
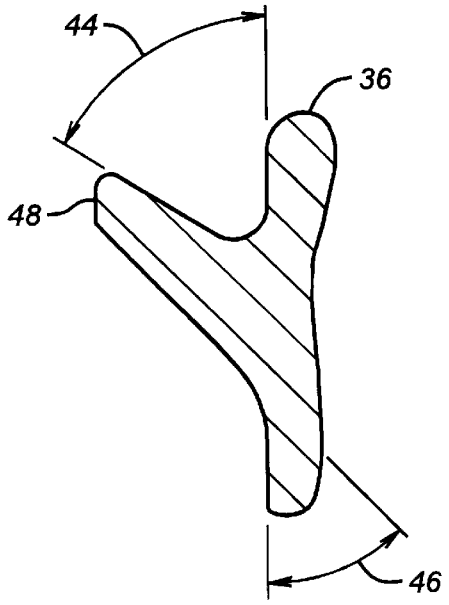
FIG. 4 is a part section view of the body of the casing patch illustrating the shape and initial orientation of one of the fins.
Figure 2:
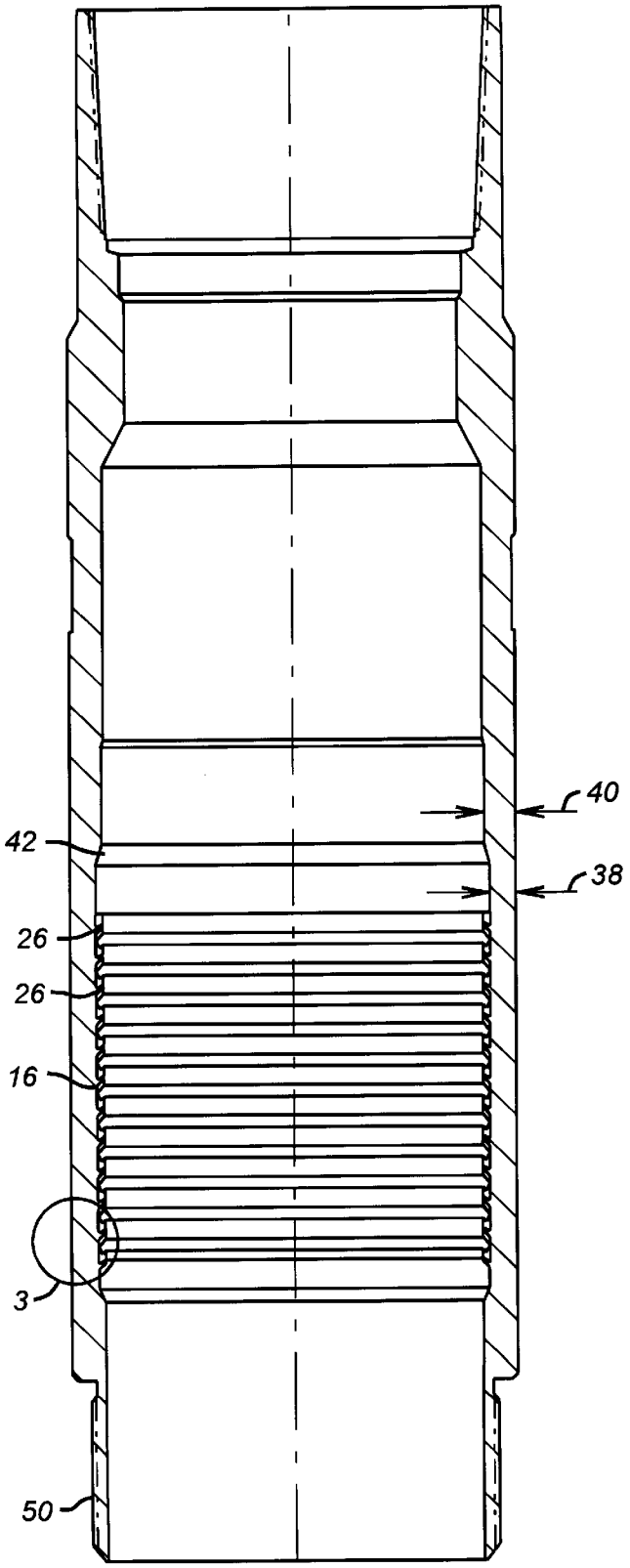
FIG. 2 is a sectional elevational view showing the embodiment that combines the fins with the elastomeric seal.
Figure 3:
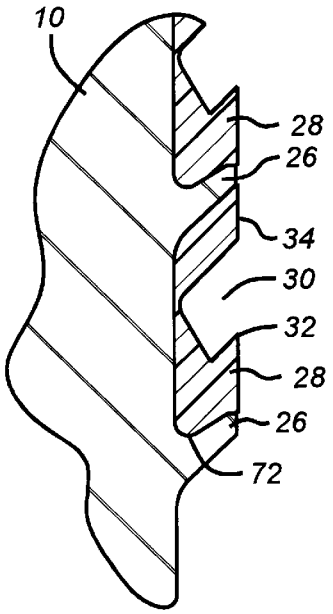
FIG. 3 is a detail of the circle labeled "3" on FIG. 2 showing in greater detail the resilient seal and how it is situated adjacent the fin structure.

FIGS. 2, 3, and 4 are helpful in better seeing the details of the seal area 16. FIG. 2 is a section view showing in more detail the seal area 16. Detail "3" of FIG. 2, which is shown in magnification in FIG. 3, illustrates the use of a plurality of circular ribs 26. FIG. 3 is a partial view showing two such ribs 26. Note that one or more ribs are within the purview of the invention. In between the ribs 26 is a resilient seal 28. The use of the resilient seal is optional. Where the thermal conditions and chemical compatibility conditions permit and additional sealing capability is required, resilient seals, such as 28, can be used in conjunction with the fins 26. In order to manufacture the casing patch seal of the present invention in conjunction with a resilient seal, such as 28, the entire space between adjacent fins 26 is filled with the material. Subsequently, a notch 30 is cut out to leave a generally V-shaped top 32 to the resilient sealing element. The remaining top portion 34 is not necessary to effectuate the seal. In essence, the fins 26 act as extrusion barriers to the resilient sealing element 28. With the aid of the extrusion barrier that spans the gap to the old stub casing 20 (see FIG. 1), the thickness of the sealing element can be reduced as compared to prior designs that did not rely on any extrusion barrier. Thus, the thickness of the wall 36 (see FIG. 4) in the area of the ribs 26 need not be reduced to accommodate the thickness of the sealing element 28. As better shown in FIG. 2, the wall thickness represented by arrow 38 is very close to the wall thickness 40 immediately above. As an example, the internal diameter above the fin area 26 is shown in FIG. 2 and above transition 42 can be 7.734 inches while just below the transition, the diameter is 7.875 inches, all dimensions being within normal tolerances for the application.

FIG. 4 shows the details of a specific fin 26. It is preferably integral to the body 10, but can also be a separate unit. It has a generally tapered form with an upper included angle 44, preferably about 55° from vertical (an acute included angle), and a lower angle 46 shown in FIG. 4 to be preferably about 45° from vertical. As a result, closer to wall 36 the cross-section of the fin 26 is greater than it is at the tip 48. Other included angle orientations are possible or even different angles in a given stack of fins. The seal assemblies need not all be identical. Some can have reverse orientations to others so that the fins 26 can, in conjunction with said seal assemblies 28, function in two opposite directions to hold pressure. Thus, in the areas of greater stress concentration, the fins 26 have a greater cross-sectional area to facilitate their flexure elastically to accept the old casing 20. The inside diameter defined by the tips 48 of each of the fins 26 need not be identical. Referring to FIG. 2, the fins 26 closer to transition 42 can have a slightly smaller internal diameter measured at the tips 48 than the remaining fins further down which are closer to the thread 50 which supports the slip area 18 shown in FIG. 1. Again, those skilled in the art will appreciate that the slip area 18 is intended to schematically represent a known gripping device. In the preferred embodiment, a releasable gripping device of known design, such as illustrated in the Bowen tool, is acceptable for service in the casing patch C of the present invention.

Figure 6:
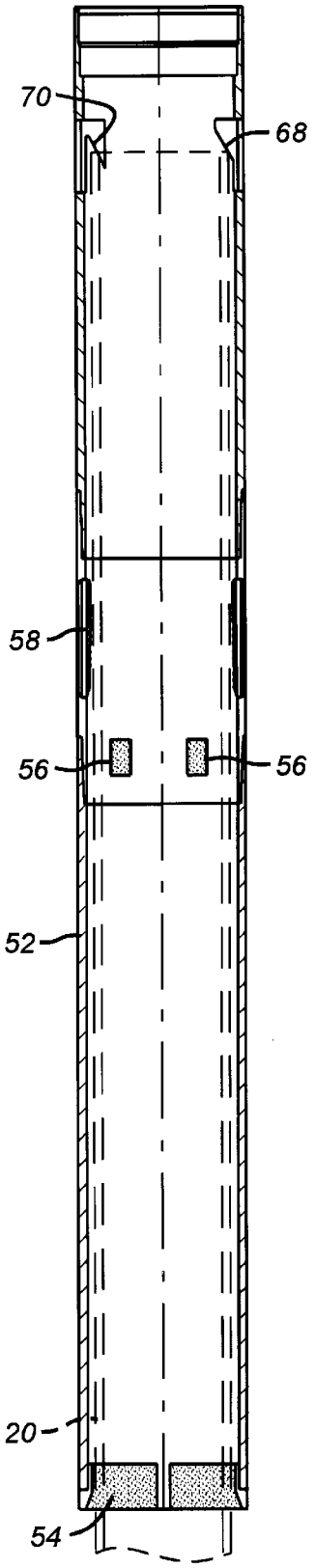
FIG. 6 is the sectional representation of the dressing tool for the stub portion of the casing prior to assembling the casing patch.
Figure 7:
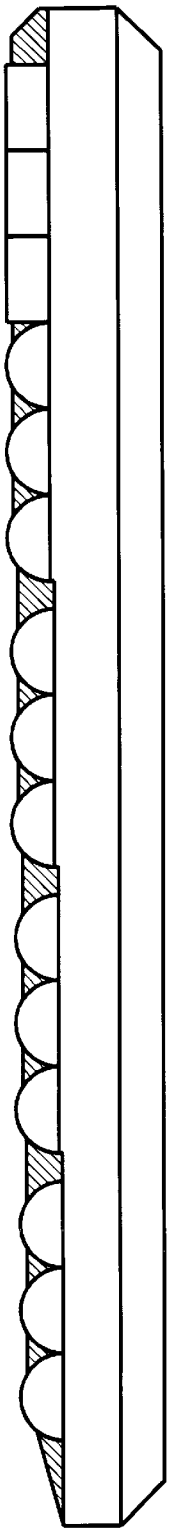
FIG. 7 is a side view of the gauge mill blade in the tool depicted in FIG. 6.
Figure 8:
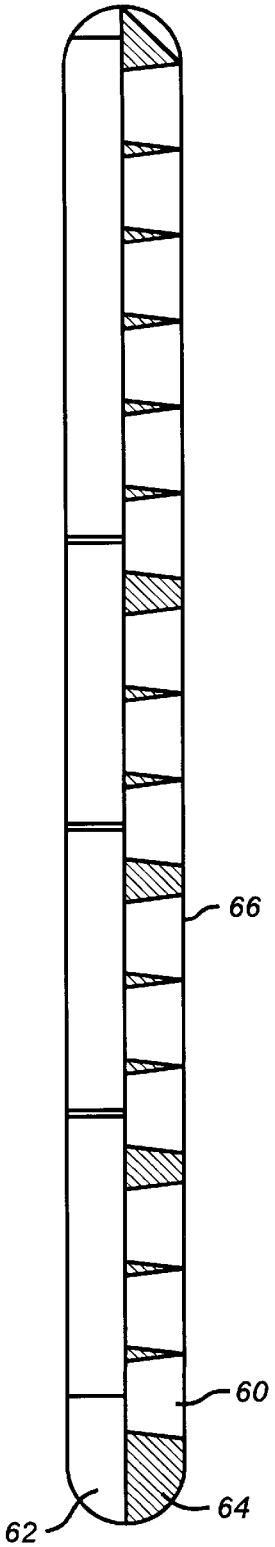
FIG. 8 is a front view of the blade shown in FIG. 7.

In order to obtain a reliable seal using just one or more fins 26, surface preparation of the old casing 20 is helpful. The dressing tool illustrated in FIG. 6 is used to adequately prepare the old casing 20 prior to advancing the body 10 over it. The dressing tool of FIG. 6 has a body 52 which houses a lower mill 54. The lower mill 54 slips over the old casing 20, shown in dashed lines in FIG. 6 when it is inside the body 52. The lower mill 54 is intended to knock off scale and other external contamination and is generally formed by a coating of a brazing material with tungsten-carbide chunks, known as SUPERLOY® when sold by Baker Oil Tools. As the body 52 advances over the old casing stub 20, it comes in contact with stabilizer pads 56. The stabilizer pads are again internal to the body 52 and are disposed around its periphery adjacent to the gauge mill 58. The gauge mill is a series of blades within the body 52 and away from its lower end. An end view of one blade is shown in FIG. 7 and a front view is shown in FIG. 8. As shown in FIG. 8, a single column of inserts 60 is used on a particular blade 62. The inserts are brazed to the blade 62 with a known brazing material which can also have chucks of tungsten-carbide in it. The inserts or buttons 60 have a semi-circular cross-section as shown in the end view of FIG. 7. Near the top, the preferred shape is rectangular in cross-section. As shown in FIG. 8, inserts 60 have a slight taper to them and present a relatively continuous cutting line 66. A series of such blades 62 can be used. In conjunction with the stabilizer pads 56, the blades 62 can deliver an external surface on the old casing 20 which is a 63 Micron finish, which is normally only attainable in a machine shop and has heretofore been unattainable with known dressing tools. As the dressing tool of FIG. 6 further advances, the old casing stub 20 encounters a bevel 68 which puts an external bevel on the top of the old casing 20 and a reverse bevel 70 which puts an internal bevel on the top of the old casing 20. The old casing 20 then has an internal and external bevel which comes to a point, thus facilitating the insertion of the body 10 of the casing patch C of the present invention. The gauge mill 58 works akin to the well known Baker Oil Tools line of metal muncher milling products which employ tungsten-carbide inserts in a row or a column as described in U.S. Pat. Nos. 4,796,709 and 5,456,312 which are fully incorporated by reference as if fully set forth. After the dressing tool of FIG. 6 has been properly employed, the casing patch C can be advanced over the old casing 20 and the slip area 18 engaged to complete the joint. As the body 10 is advanced over the old casing 20, the tips 48 of fins 26 flex upwardly and ride along the now polished outer surface of the old casing 20. As previously stated, since in the preferred embodiment some of the fins will have a larger inside diameter toward the thread 50 than the transition 42, any dimensional irregularities (such as a slight out of roundness) that are still present on the outer surface of the old casing 20 after use of the dressing tool will not make a difference as one or more of the ribs or fins 26 come into all around metal-to-metal contact with the outer surface of the old casing 20. The fins 26 are stressed when in contact with the casing stub 20 to ensure good metal to metal contact. Thus, in one embodiment, particularly where high temperatures are expected, and resilient materials are not suitable, the casing patch C makes a metal-to-metal seal with one or more of the ribs 26, which are in an interference fit with the old casing 20. The slips or grapple mechanisms 18 hold the casing patch C to the old casing 20. Alternatively, if the fins 26 are used in conjunction with a resilient seal 28, which can be rubber or plastic or other man made or naturally occurring material suitable for the application, the fins 26 again span the potential extrusion gap between the body 10 and the old casing 20. With the support lent by the fins 26, the sealing elements which have a generally chevron-type appearance when observed in cross-section, as shown in FIG. 3, function as a back-up to the metal-to-metal seal provided by the fingers or fins 26. It can be seen from FIG. 3 that the lower end 72 of a particular resilient seal 28 is generally V-shaped conforming generally to the V-shape upper end 32. As a result, the seal 28 functions akin to a chevron seal. The chevron-shaped seals 28 can be aligned or some can be inverted for sealing in both directions. However, with the polishing, which has already initially occurred using the dressing tool, and the fins 26 acting as back-up, the required radial thickness of the seal 28 is reduced such that for a fin having a seal inside diameter of about 7.506 inches, the thickness of the seal 28 is about 0.185 inches as compared to a fin 26 having an inside diameter of 7.566 inches where the thickness of the seal 28 is 0.155 inches. These relative dimensions are an example of an installation for 7⅝ inch 39 casing.

Figure 5:
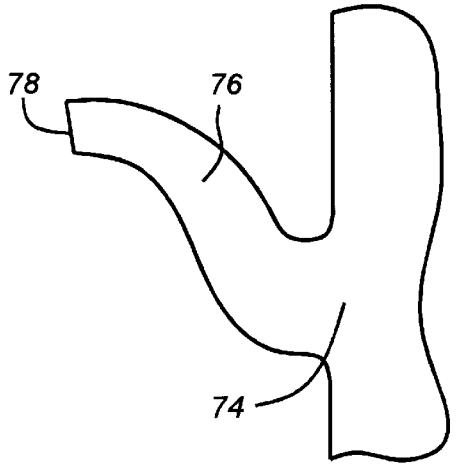
FIG. 5 is an alternative shape for one of the fins shown in section.

FIG. 5 illustrates an alternative shape for the fin 26. It has a thick base 74 going into a generally tapered body 76 and a blunt tip 78. Using known stress analysis techniques, other shapes can be used without departing from the spirit of the invention. Once the anticipated amount of flexure is known, as well as the pressure differential limits during service, known stress analysis techniques can be used to define a variety of shapes which will flex to bridge the gap to allow the body 10 to slip over the old casing 20 without the fins 26 being pushed so far back that the effectiveness of bridging the gap disappears. On the other hand, the preferred upper included angle 44 is kept in the range of about 55° in the preferred embodiment, although other angles could be used so as to optimize the ability of the fins to resist differential pressure in one or two opposite directions once the casing patch C is assembled.

Those skilled in the art can see that the use of one or more flexing fins 26 can result in a casing patch C which seals on a metal-to-metal basis. With the variety of internal diameters on a series of fins 26, as measured at the tips 48, any surface imperfections, even after dressing, can be accommodated by one or more of the fins 26. Should additional sealing capability be desired, the sealing element, such as 28, can be used. In the preferred embodiment having a generally chevron-like shape, the thickness of such seals 28 is fairly small since the adjacent fin 26 effectively bridges the extrusion gap. As previously described, alternative shapes of cantilevered structures can serve as the fins 26 while different shapes and materials can be used for the resilient seal 28, all without departing from the spirit of the invention. The resilient seal 28 can be bonded to the body 10. The tool, when run with known overshots, can be releasably secured to the old casing 20 so that, if for any reason, the integrity of the seal is jeopardized, the casing patch C can be removed without having to cut the casing to get it out.

With the design as described, the pressure rating of the joint is at least equal to the pressure rating of the old casing 20. The ability to provide a metal-to-metal seal using the fins 26 is facilitated by the dressing tool which uses in combination the stabilizers 56, which are a plurality of internal projections, to support and properly center the pipe while the blades 62 with inserts 60 provide a smooth finish in the order of about 63 Microns.

The foregoing disclosure and description of the invention are illustrative and explanatory thereof, and various changes in the size, shape and materials, as well as in the details of the illustrated construction, may be made without departing from the spirit of the invention.

We claim:

1. A casing patch apparatus for connecting on to a stub casing in a wellbore comprising:

a tubular body having an opening large enough to pass over the stub;

a seal assembly comprising at least one cantilevered fin mounted within said body, said fin having an initial inner diameter smaller than the outer diameter of the stub such that it is deflected as said body is advanced over the stub, said fin providing a metal-to-metal seal between said body and the stub;

a gripping assembly to hold said body to the stub.

2. The patch of claim 1, further comprising:

at least one resilient seal supported by said fin.

3. The patch of claim 2, wherein:

said seal has a chevron shape.

4. The patch of claim 1, wherein:

said body has a minimum wall thickness sufficient to give it strength at least equal to the strength of the stub.

5. The patch of claim 2, wherein:

said body has a minimum wall thickness sufficient to give it strength at least equal to the strength of the stub.

6. The patch of claim 3, wherein:

said body has a minimum wall thickness sufficient to give it strength at least equal to the strength of the stub.

7. The patch of claim 1, further comprising:

a plurality of fins, each having a tip and defining an internal diameter through which the stub passes;

said fins are arranged in a vertical stack where some internal diameters are different than others.

8. The patch of claim 7, wherein:

said body has a lower end which has said opening;

said internal diameters decrease in dimension moving away from said lower end.

9. The patch of claim 8, wherein:

said fin is a unitary structure with said body and tapers down in the direction from said body to a cantilevered end thereof.

10. The patch of claim 9, wherein:

said fin has a longitudinal axis which forms an acute included angle with a longitudinal axis of said body.

11. The patch of claim 1, wherein:

said gripping assembly is selectively releasable.

12. The patch of claim 2, further comprising:

a plurality of fins in a stack with one said resilient seal adjacent each fin, whereupon each fin when in contact with the stub serves as an extension barrier for said adjacent seal.

13. The patch of claim 12, wherein:

said seal has a chevron shape.

14. The patch of claim 13, wherein:

said body has a minimum wall thickness sufficient to give it strength at least equal to the strength of the stub.

15. The patch of claim 13, further comprising:

a dressing tool for preparing the stub prior to advancing said body over the stub comprising:

a tubular body having an opening at a lower end thereof which accepts the stub;

an internal mill within said dressing tool tubular body and away from said lower end to polish the surface of said stub to facilitate a metal-to-metal seal with said fin.

16. The patch of claim 15, further comprising:

a stabilizer assembly in said dressing tool body adjacent said internal mill to stabilize the stub as its surface is milled.

17. The patch of claim 16, wherein:

said internal mill comprises a plurality of blades, each having at least one column of tungsten-carbide inserts which form a cutting edge.

18. The patch of claim 17, further comprising:

a second mill adjacent said lower end for removal of scale or contaminants prior to surface polishing with said internal mill above;

an internal and external bevel cutters in said dressing tool body to provide a generally V-shaped tip to the stub to facilitate subsequent passage of said tubular body over the stub.

19. A method of preparing a downhole casing tubular comprising:

using a dressing tool to polish the exterior surface of a casing stub in the wellbore;

connecting a casing patch housing to a string and lowering it to the stub;

providing at least one cantilevered metal fin around the inside said housing;

lowering an open end of said housing over the stub;

deflecting said fin as said housing is advanced over the stub;

providing a metal-to-metal, seal as said fin contacts all around the polished portion of the stub;

securing the housing to the stub.

20. The method of claim 19, comprising:

using a plurality of blades mounted within said dressing tool and away from its lower end to accomplish said polishing.

21. The method of claim 20, comprising:

providing stabilization to the stub while said blades are polishing it.

22. The method of claim 21, comprising:

using tungsten-carbide inserts on said blades;

using a lower mill on said dressing tool for rough surface preparation prior to contact by said blades;

providing a generally V-shaped bevel on the top of the stub after said polishing is completed.

23. The method of claim 19, comprising:

providing a resilient seal adjacent said fin;

sealing between said housing and the stub with said resilient seal;

using said fin as an extrusion barrier for said resilient seal.

24. The method of claim 23, comprising:

providing a chevron shape for said seal.

25. The method of claim 23, further comprising:

using a plurality of fins in a stack with a resilient seal adjacent each said fin.

26. The method of claim 25, comprising:

providing a chevron shape for said seal;

providing a variation in diameters defined by the tips of said fins in said stack.

27. The method of claim 25, further comprising:

orienting the fins at an included acute angle with the longitudinal axis of the casing patch housing.

28. The method of claim 27, comprising:

providing a narrowing taper for said fins as they extend from said casing patch housing to said tip thereof.

29. The method of claim 22, comprising:

providing a resilient seal adjacent said fin;

sealing between housing and the stub with said resilient seal;

using said fin as an extrusion barrier for said resilient seal.

30. The method of claim 29, comprising:

using a plurality of fins in a stack with a resilient seal adjacent each said fin.

31. The method of claim 30, comprising:

providing a chevron shape for said seal;

providing a variation in diameters defined by the tips of said fins in said stack.

32. The method of claim 30, further comprising:

orienting the fins at an included acute angle with the longitudinal axis of the casing patch housing.

33. The method of claim 32, comprising:

providing a narrowing taper for said fins as they exit from said casing patch housing to said tip thereof.

* * * * *